US005183025A

United States Patent [19]

Jorstad et al.

[11] Patent Number: 5,183,025

[45] Date of Patent: Feb. 2, 1993

[54] ENGINE BLOCK AND CYLINDER LINER ASSEMBLY AND METHOD

[75] Inventors: John L. Jorstad; Richard A. Morely, both of Richmond; William H. Overbagh, Chesterfield, all of Va.

[73] Assignee: Reynolds Metals Company, Richmond, Va.

[21] Appl. No.: 772,727

[22] Filed: Oct. 7, 1991

[51] Int. Cl.[5] ..... F02B 75/08

[52] U.S. Cl. ..... 123/669; 123/193.2; 29/888.061

[58] Field of Search ..... 123/41.84, 193.2, 668, 123/669; 29/888.061, 888.01, 888.046, 888.06

[56] References Cited

U.S. PATENT DOCUMENTS

| | | | |
|---|---|---|---|
| 1,359,719 | 11/1920 | Mead | 164/75 |
| 2,455,457 | 12/1948 | Whitfield et al. | 29/888.061 |
| 2,634,469 | 4/1953 | Pershing et al. | 169/75 |
| 2,672,666 | 3/1954 | Enfer et al. | 169/75 |
| 2,849,790 | 9/1958 | Zwicker | 164/75 |
| 2,974,380 | 3/1961 | Jominey et al. | 164/102 |
| 3,342,564 | 9/1967 | Schwartz et al. | 428/663 |
| 3,945,423 | 3/1976 | Hannig | 164/75 |
| 4,008,052 | 2/1977 | Vishnevsky et al. | 428/612 |
| 4,637,110 | 1/1987 | Yamagata | 29/888.061 |
| 4,687,043 | 8/1987 | Weiss et al. | 164/97 |
| 4,986,230 | 1/1991 | Panyard et al. | 123/193.2 |
| 5,012,776 | 5/1991 | Yamagata | 123/193.2 |

FOREIGN PATENT DOCUMENTS

| | | |
|---|---|---|
| 52-17330 | 2/1977 | Japan . |
| 62-89564 | 4/1987 | Japan . |

*Primary Examiner*—Noah P. Kamen
*Attorney, Agent, or Firm*—Alan M. Biddison

[57] ABSTRACT

An engine block for an internal combustion engine including at least one bore, and a cylindrical liner that is pressed into the bore to define the inner cylindrical surface along which the piston reciprocates. The inner surface of the bore and the outer surface of the liner are each coated with a zinc or zinc alloy coating that is metallurgically bonded to the respective surfaces to form intermetallic bonds. The liner is pressed into the bore while the liner and bore are at an elevated temperature approximately corresponding to the melting temperature of zinc, in order to unite the liner and block by means of a metallurgical bond. The metallurgical bond is substantially continuous to provide a continuous metallic path for improved heat transfer and structural strength between the liner and the block material. The liner can be formed either from cast iron or from an aluminum alloy, and the engine block is preferably cast from an aluminum alloy.

34 Claims, 1 Drawing Sheet

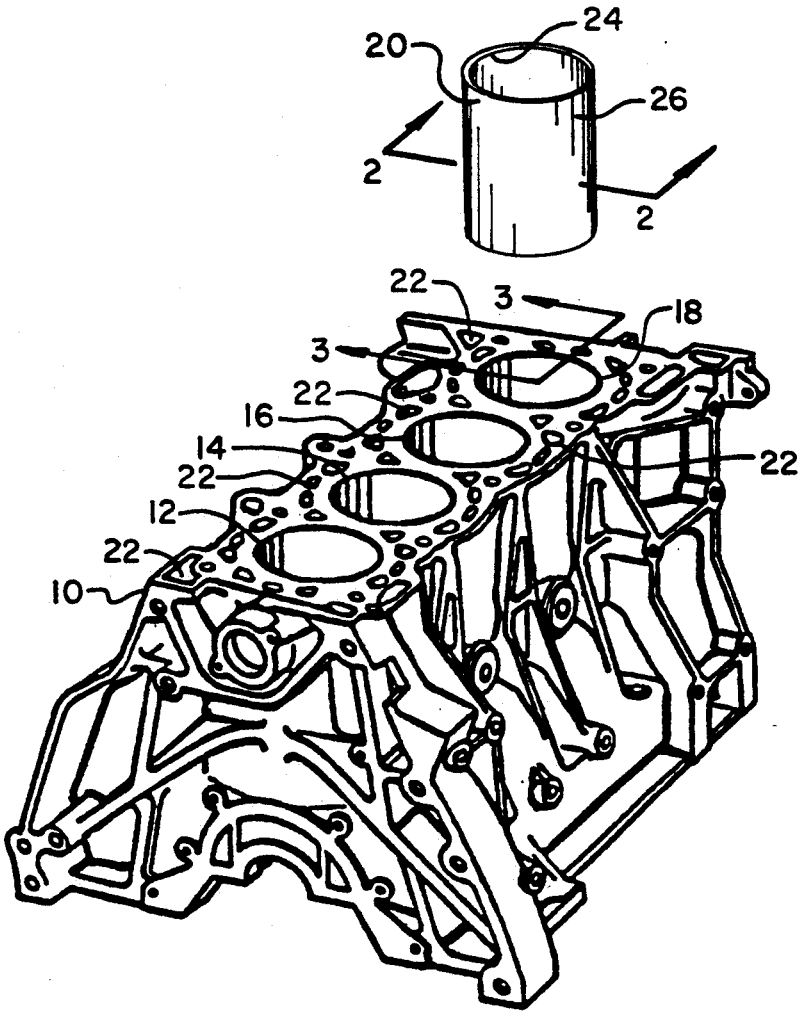
FIG. 1
FIG. 2
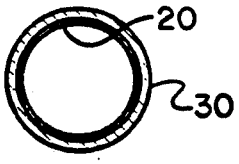
FIG. 3
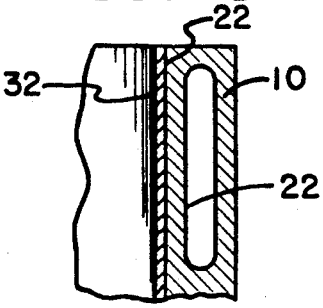
FIG. 4
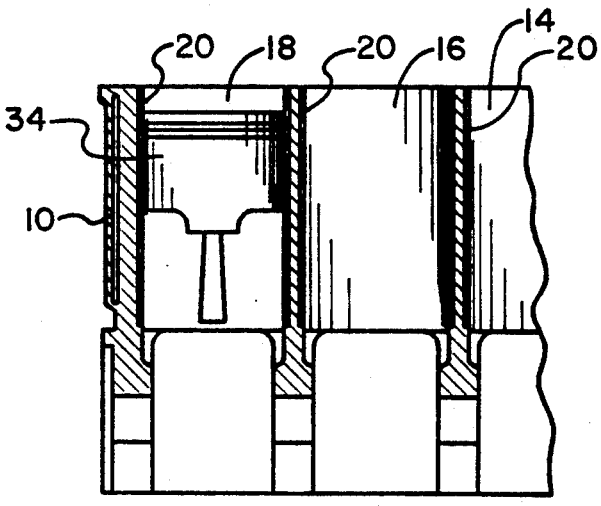

ENGINE BLOCK AND CYLINDER LINER ASSEMBLY AND METHOD

BACKGROUND OF THE INVENTION

1. Field of the Invention

The present invention relates to an aluminum alloy engine block for an internal combustion engine, the block incorporating tubular cylinder liners made from a material or an alloy that is different from the composition of the aluminum alloy engine block. More particularly, the present invention relates to an aluminum alloy engine block into which cylindrical liners are adapted to be physically pressed, in which the liners are formed from either a ferrous alloy or an aluminum alloy, and in which the interfaces between the outer surfaces of the liners and the inner surface of the respective cylinder bores are metallurgically bonded to provide a firm interconnection and good heat transfer.

2. Description of the Related Art

Engine blocks for internal combustion engines, such as those engines adapted to be installed in vehicles, such as automobiles, have for a long time been made of cast iron for the necessary rigidity, and also for resistance to cylinder wear caused by the rapid sliding movement within a cylinder bore of a cylindrical piston having several piston rings. The use of cast iron results in a very heavy engine which, because of its weight, requires increased fuel consumption to operate the automobile, which runs counter to the modern trend of providing lighter weight automobiles and lighter weight engines for increased fuel economy.

One way to provide a lighter engine is to make the engine block from an aluminum alloy that has the required strength and wear attributes, because aluminum alloys have a considerably lower density which results in lighter weight. Although aluminum alloys are available that are suitable for casting and that have the required resistance to wear to ensure long, trouble-free engine life, at times it might be desirable to provide an engine block formed from one aluminum alloy and a cylinder liner that is formed from a second aluminum alloy. Additionally, there are times when it might be desirable to provide cylinder liners that are made of cast iron. In that regard, U.S. Pat. No. 4,637,110, which issued on Jan. 20, 1987, to Hiroshi Yamagata, discloses an aluminum alloy engine block for a two-cycle engine. A cast iron cylinder liner is cut from a section of cylindrical pipe, and lateral port openings are formed in the liner, which is subsequently pressed into the cylinder bore provided in the engine block. However the mere mechanical connection between a cylinder liner and a cylinder bore is discontinuous and often inadequate to provide an unimpeded heat transfer path over the physical interface between the liner and the cylinder bore.

Another description of the insertion of a cylinder liner into a light weight cast aluminum alloy engine block appears in U.S. Pat. No. 4,986,230, which issued on Jan. 22, 1991, to James R. Panyard et al. The latter patent teaches a method for mechanically bonding a cylinder liner to a cylinder bore by inserting the liner into the bore and then forcing a mandrel through the interior of the liner to stretch the liner radially outwardly against the inner surface of the cylinder bore to provide increased surface-to-surface contact area. However because of the process disclosed, the liner must be made from a ductile material, which normally rules out cast iron, and consequently requires the liner be made of a high-ductility steel having at least 30% elongation capability. Again, because of the mechanical bond between the liner and the bore, uniform and unimpeded heat transfer is difficult to maintain.

It is an object of the present invention to overcome the deficiencies in the prior art arrangements for securing a cylinder liner in a bore in an aluminum alloy engine block.

It is another object of the present invention to provide an aluminum alloy engine block having cylinder liners that are made of materials different from that of the block and in which the liner and block are joined by a metallurgical bond.

SUMMARY OF THE INVENTION

Briefly stated, in accordance with one aspect of the present invention, an engine block is provided for an internal combustion engine wherein the block is made of an aluminum alloy material having at least one bore for receiving a slidable piston. The bore includes a liner made either from another aluminum alloy or from a ferrous material such as cast iron or steel. The outer surface of the liner and the inner surface of the cylinder bore are joined by a layer of a bonding metal that provides a sound metallurgical bond between the block and the liner. The bonding metal layer is substantially continuous and provides a substantially continuous heat transfer and structural load carrying path between the sleeve and the block for improved engine performance.

In accordance with another aspect of the present invention, a method is provided for joining a liner with an aluminum alloy engine block. The liner has an outer coating of bonding metal, and the aluminum alloy engine block has a similar coating on the interior surface of the bore. The liner and block are each heated to a temperature sufficiently high to soften or melt the respective bonding metal coatings on the liner and bore. The liner is then pressed into the heated cylinder bore to cause fracturing of the oxides on the surfaces of the bonding metal coatings at the interface between the liner and the bore in order to metallurgically join the liner with the bore to form a substantially continuous heat transfer and structural path between the liner and the block.

BRIEF DESCRIPTION OF THE DRAWINGS

FIG. 1 is a schematic perspective view showing an engine block for a four cylinder automobile engine with a cylinder liner positioned above one of the bores immediately before the liner is pressed into the block in accordance with the present invention;

FIG. 2 is a cross-sectional view taken along the line 2—2 of FIG. 1 showing a transverse cross section through the liner;

FIG. 3 is an enlarged, fragmentary, cross-sectional view taken along the line 3—3 of FIG. 1, showing a longitudinal cross section through a portion of a cylinder bore;

FIG. 4 is a fragmentary, longitudinal cross-sectional view, partially broken away, taken along a portion of the longitudinal axis of the block shown in FIG. 1, illustrating liners installed in several cylinder bores of the block.

DESCRIPTION OF THE PREFERRED EMBODIMENTS

Referring now to the drawings, and particularly to the FIG. 1 thereof, there is shown an engine block 10 including four individual cylinder bores 12, 14, 16 and 18, each having their respective axes parallel with each other and spaced from each other along the longitudinal axis of the block. A tubular cylindrical liner or sleeve 20 is shown in position above end-most cylinder bore 18 preparatory to a pressing operation whereby liner 20 is pressed into bore 18 to provide a desired wear surface for a reciprocating piston (not shown) slidably carried within the liner. As will be appreciated, each of cylinder bores 12, 14, and 16 is also intended to receive a liner 20 that is pressed into the bore, but only one such liner is shown for clarity of illustration. Further, those skilled in the art will understand that a cylinder head (not shown) is secured to the top of block 10 and an oil pan (not shown) is attached to the bottom of the block, and it will also be appreciated that other arrangements of the bores within the block are possible.

Engine block 10 is preferably of cast aluminum alloy construction and made from any of several alloys, for example, alloys 319, 333, 356 and 380, each of which has desirable strength and weight in a composition that is readily cast and machined. As shown in FIG. 1, engine block 10 includes a plurality of individual passageways 22 extending generally along the peripheries of bores 12, 14, 16, and 18 to provide channels through which a coolant can be circulated to maintain the temperature of the block at or below a predetermined temperature during its service as an engine. Although illustrated and described in the context of a liquid-cooled engine having internal coolant passageways, it will be apparent to those skilled in the art that the present invention can also be applied to air-cooled engines, possibly including external cooling fins.

Cylinder liner 20 can be made from either a ferrous material, such as cast iron, or from a suitable aluminum alloy, such as alloy 390. Each liner 20 includes a cylindrical inner surface 24 and a cylindrical outer surface 26, and is adapted to fit snugly within a cylinder bore as will be hereafter explained in greater detail.

Although it is well known to press cylindrical liners into engine block cylinder bores, even an interference fit between the liner and cylinder bore has been found not to provide the desired heat transfer characteristics between liner inner surface 24 and coolant passageways 22 to avoid excessive heating of the liners after installation and during service of the engine. In that regard, it has been found that the provision of a metallic bonding layer, such as a zinc coating, on the exterior cylindrical surface 26 of the cylinder liner 20 and also on the interior cylindrical surface of the cylinder bore 18 before installation of the liner results in the liner being metallurgically bonded to the block in a pressing operation in which particular conditions are maintained. In the case of cast iron, the application of a zinc coating, such as by a hot dip process, causes the zinc and cast iron to react to form intermetallic layers of different alloys of iron and zinc when conditions are favorable. Thus the interior of the sleeve remains cast iron, and adjacent to the outer surface a plurality of zinc-iron and other zinc alloys are formed.

Although the bonding layer herein described is a zinc or a zinc alloy coating, it can also be a coating based upon other metal systems, for example, tin or an alloy containing substantially about 95% tin and about 5% zinc, by weight, or substantially about 95% tin and about 5% antimony by weight. In that regard, it is important that the coating material employed have a lower melting temperature than the melting temperatures of the materials to be bonded, and also that the coating material form intermetallic compounds or alloys with each of the materials to be bonded, such as an engine block and an engine cylinder liner.

Various types of hot dip zinc coating processes are available. One such process involves the provision of two separate molten zinc furnaces. Initially, a machined cylindrical cast iron cylinder liner or sleeve is degreased in trichloroethylene or a similar degreasing compound and is permitted to air dry. The outer cylindrical surface of the liner is steel grit blasted or otherwise treated to remove any surface debris. The treatment is continued until a uniform, clean, whitish metallic surface is obtained. The inside surface of the sleeve is coated with a wash, such as Stahl Speciality Company's ladle wash Micawash 15, or the like. The wash is applied to the inner surface of the liner in order to prevent adhesion of zinc on the inside surface of the liner. After the wash is applied to the liner it is dried in an oven at 200° F., after which the liner can be recoated with wash and redried, if desired. It will be appreciated that it also is possible to protect the inner surface by sealing the ends of the liner.

Molten zinc can be provided in a pair of separate zinc baths in which cast iron liners are immersed to provide a uniform and complete zinc coating on the liner outer surface. The zinc in a first bath is maintained at about 1,000° F. and has a depth sufficient to fully immerse the entire length of a liner. The liner is preferably preheated to about 250° F. and is dipped into the first molten zinc bath for a period sufficient to accomplish reaction between the iron and zinc to form intermetallic layers of zinc on the iron, for example about five to ten minutes. Immediately upon removal from the first zinc bath the liner is immersed for about 30 seconds in a second zinc bath that is maintained at a lower temperature of about 830° F., after which the liner is allowed to cool in air for about one minute and is thereafter quenched in ambient temperature water.

When aluminum alloy liners are to be pressed into an aluminum alloy block, the liners are preheated to a temperature of about 750° F. and are then inserted into molten zinc or zinc alloy contained in an ultrasonic pot and maintained at about 790° F. The liners are rotated within the zinc pot while ultrasonic energy is applied for a period of time sufficient to accomplish alloying of the zinc with the surface of the aluminum alloy liner, for example about five seconds, to fully coat the outer cylindrical surface of the liner.

In each instance involving the coating of the liner, whether the liner be cast iron or aluminum alloy, when the above-described procedures are followed a metallurgical bond is formed between the zinc coating and the liner base material.

The engine block cylinder bores are also coated with zinc. The block is first preheated in a 900° F. oven until the block temperature reaches a desired temperature above the melting point of pure zinc, for example about 40 minutes, whereupon the surfaces of the cylinder bores can be rubbed with zinc wire which melts and alloys with the aluminum bore surface. Alloying of zinc and the aluminum bore surface is further promoted by brushing the surface of the cylinder bore with a wire brush during zinc coating. Again, the foregoing procedure for coating the cylinder bores produces a metallurgical bond between the zinc and the aluminum surface.

The present invention, wherein metallurgically bonded zinc is applied both to the outer surface of the ferrous liner as well as to the surface of the cylinder bore of an aluminum block before pressing the liner into the bore, has been found to be capable of being successfully practiced over a range of sleeve-to-bore fits, ranging from about −0.004 inches to about +0.016 inches at ambient temperatures.

The exteriorly coated liners can be assembled with the interiorly coated cylinder bores by first placing the liners and the engine block in a furnace and heating for a sufficient time to bring the liners and block to a temperature of from about 800° F. to about 925° F., which is a temperature sufficient to cause the zinc coating to become soft or melt, but not flow from the zinc-coated surfaces. When the zinc on both surfaces has thus become soft, the liner is pressed into the cylinder bore, such as with an arbor press, as a result of which the liner is slidably pushed into the bore so that the resulting scraping action of the two parts fractures any zinc oxide coating on either of the zinc containing surfaces, as a result of which the two softened, oxide-free zinc surfaces come into intimate contact to form a metallurgical bond therebetween.

EXAMPLE I

A cast iron liner was formed as a tubular, cylindrical sleeve in the form of a right circular cylinder having an axial length of about 5.3 in., an inner diameter of about 3.25 in., and an outer diameter of 3.650 in. The outer cylindrical surface of the liner, preferably after machining, was sand blasted to remove any extraneous surface material or debris and to obtain a uniform, clean, whitish metallic surface. The inner cylindrical surface of the liner was painted with ladle wash (Micawash 15, available from Stahl Speciality Company) using a paint brush, to prevent adhesion of zinc to the inner surface. Two coats of ladle wash were separately applied, and the so-coated liner was oven dried at 200° F. after application of each coat.

The exterior surface of the liner was zinc coated by preheating the liner to about 250° F., dipping the heated liner into a 1000° F. molten zinc bath for 10 minutes, and then immediately immersing the liner for 30 seconds in a second zinc bath maintained at 830° F. The liner was allowed to air cool for about one minute and was then quenched in ambient water.

The aluminum engine block was simulated by providing a cast aluminum cylinder made from aluminum alloy 319. The cylinder had an axial length of about 5.3 in., an outer diameter of about 4.75 in., and an inner diameter of 3.652 in., and was heated in an 900° F. oven for approximately one hour to obtain a surface temperature sufficient to melt the zinc and uniformly alloy the aluminum surface with the molten zinc.

For both the zinc coated liner and the zinc coated cylinder, the zinc coating was metallurgically bonded to the respective substrates.

The liner and cylinder were then heated in a 900° F. oven for about 15 minutes, until the zinc surfaces appeared soft. The heated liner was then pushed into the heated cylinder at a steady, substantially constant force using an arbor press, until the iron liner was completely within the aluminum alloy cylinder.

After cooling, metallographic evaluation revealed a joint having a thickness ranging between 7 and 20 mils, a bond over about 90% of the joint area, and very little porosity. An ultrasonic evaluation of the bond using a Krautkramer-Branson ultrasonic tester resulted in a bond value of 74, on a scale of from 0 to 100, which is excellent. A subsequent attempt to push the liner axially from a 1 inch long section cut from the length of the sleeve required 61,000 lb. of force to effect push-out.

EXAMPLE II

An aluminum alloy liner was formed as a tubular, extruded cylindrical sleeve from aluminum alloy 390. The liner had an axial length of about 6 in. and an outer diameter of 3.738 in. The outer surface of the liner was zinc coated for 5 sec. by rotating the liner preheated to 750° F. in an ultrasonic zinc pot maintained at about 790° F. to provide a metallurgically bonded zinc outer coating.

A cast 319 aluminum alloy cylinder was prepared in the same manner as in Example I. The cylinder had a length of about 6 in. and an inner diameter of 3.734 in.

The liner and cylinder were preheated with a torch and the liner was then inserted into the cylinder. After cooling of the pressed assembly the ultrasonic measure of the bond was 65, which is excellent. The resistance to axial push-out of the liner from a 1 inch section of the sleeve was determined to be 37,000 lb.

The following Tables I and II present the results of tests performed following the procedures outlined immediately above. In Table I the liner material is cast iron and the cylinder (simulated block) material is 319 aluminum alloy. Various liner O.D. and cylinder I.D. values were run to provide a range of clearances between the parts. Analyses of the resulting assemblies after joining of the liners and the cylinders are also presented, and show the results of metallographic evaluations in terms of the percent of available surface area that has been bonded, the thickness of the joint in terms of the thickness of the zinc material between the respective base materials, and a qualitative assessment of the absence of porosity at the joint. Other tests that were performed involved attempts to push the liners from the 1 inch sections cut from the length of the cylinders, which resulted in what is referred to in the tables as "push-out strength". Finally, an ultrasonic measure of the percentage of bond was made to provide an indication of relative bond quality, the higher the number the better the bond.

TABLE I

| Sleeve O. D. Inches | Cylinder I. D. Inches | Clearance Inches | Preheat Temp. F.* | Metallographic Evaluation: Percent Bonded | Joint Thk (Mils) | Absence of Porosity* | 1 in. Section Push-Out Strength (K-Lbs) | Ultrasonic Measure of Bond |
|---|---|---|---|---|---|---|---|---|
| 3.7385 | 3.7285 | −0.0100 | 875 | — | — | — | — | — |
| 3.7385 | 3.7385 | 0.0000 | 875 | 100 | 18.3 | E | — | — |
| 3.7385 | 3.7400 | 0.0015 | 875 | 90 | 10.1 | E | — | — |
| 3.7400 | 3.7440 | 0.0040 | 875 | 80 | 20.8 | E | — | — |
| 3.7380 | 3.7440 | 0.0060 | 875 | 90+ | 21.1 | E | — | — |

TABLE I-continued

| Sleeve O. D. Inches | Cylinder I. D. Inches | Clearance Inches | Preheat Temp. F.* | Metallographic Evaluation Percent Bonded | Joint Thk (Mils) | Absence of Porosity* | 1 in. Section Push-Out Strength (K-Lbs) | Ultrasonic Measure of Bond |
|---|---|---|---|---|---|---|---|---|
| 3.7385 | 3.7480 | 0.0095 | 875 | 55 | 12.2 | E | — | — |
| 3.6500 | 3.6520 | 0.002 | 900 | 90 | 7–20 | E | 61 | 74 |
| 3.6500 | 3.6520 | 0.002 | 900 | 66 | 14–20 | E | 59 | 67 |
| 3.6500 | 3.6520 | 0.002 | 900 | — | — | — | — | — |
| 3.6500 | 3.6540 | 0.004 | 900 | 65 | 14–21 | E | 48 | 66 |
| 3.6500 | 3.6554 | 0.004 | 900 | — | — | — | — | — |

*Visual observation
E = excellent
G = good
F = fair
P = poor

The following Table II is similar to Table I, except that Table II applies to liners that were made from 390 aluminum alloy, while the cylinder material was 319 aluminum alloy. The metallographic evaluation and bond quality criteria presented in Table II are similar to those provided in Table I.

TABLE II

| Sleeve O. D. Inches | Cylinder I. D. Inches | Clearance Inches | Preheat Temp. F.* | Metallographic Evaluation Percent Bonded | Joint Thk (Mils) | Absence of Porosity | 1 in. Section Push-Out Strength (K-Lbs) | Ultrasonic Measure of Bond |
|---|---|---|---|---|---|---|---|---|
| 3.7380 | 3.7340 | −0.0040 | 950 | — | — | — | 37 | 65 |
| 3.7380 | 3.7380 | 0.000 | 950 | — | — | — | 40 | 42 |
| 3.7380 | 3.7420 | 0.004 | 950 | — | — | — | 7 | 15 |
| 3.7380 | 3.7460 | 0.008 | 950 | — | — | — | 7 | 7 |
| 3.7380 | 3.7500 | 0.012 | 950 | — | — | — | 25 | 13 |
| 3.7380 | 3.7540 | 0.016 | 950 | 1–8 | — | E | 24 | 24 |
| 3.7420 | 3.7370 | −0.005 | 820 | 92 | 0–2.3 | E | 45 | — |
| 3.7420 | 3.7370 | −0.005 | 820 | 68 | 0–4 | E | 64 | — |

Referring once again to the drawings, and particularly to FIGS. 2–4 thereof, there is shown in FIG. 2 a cross-sectional view taken through a liner 20 that includes a zinc coating 30 uniformly applied to the exterior surface thereof. Similarly, FIG. 3 shows a cross-sectional view of a portion of a cylinder bore 22 having a uniform thickness internal coating 32 of zinc, and an internal cooling passage 22. FIG. 4 shows a cross section of engine block 10 taken along the longitudinal axis with liners 20 in place, metallurgically bonded to the respective bores 18, 16 and 14, with one of the thus-lined bores including a reciprocating piston 34.

As is apparent from the data presented in Tables I and II, in addition to the method in accordance with the present invention providing a liner-to-bore bond that is free of excessive porosity, and that thereby promotes improved heat transfer across the bond, the method also results in improved structural integrity of the assembly of joined elements. In that regard, the push-out strengths for various of the test samples shown in the tables demonstrate the strong structural bond that results at the liner-bore inerface. Although a precise minimum acceptable value for push-out strength has not been established, it is believed that values greater than 5,000 lb. are indicative of an acceptable bond.

The invention is not restricted to the installation of cylinder liners into cylinder bores, but can also be followed to install and secure valve guides and valve seats in cast aluminum cylinder heads, or to install and secure other such inserts into cast or wrought aluminum articles for purposes of improving the performance of the aluminum articles in local areas.

Although particular embodiments of the present invention have been illustrated and described, it will be apparent to those skilled in the art that various changes and modifications to coating and component assembly procedures, temperatures, and the like can be made without departing from the spirit of the present invention. Accordingly, it is intended to encompass within the appended claims all such changes and modifications that fall within the scope of the present invention.

What is claimed is:

1. An engine block for an internal combustion engine, said engine block comprising:

a) an aluminum alloy engine block body having at least one cylinder bore;

b) a metallic liner received within the at least one cylinder bore and in intimate contact with the bore;

c) a bonding layer of a metallic material having as a major constituent thereof on a weight basis a bonding metal having a melting temperature substantially lower than the melting temperatures of the engine block body and of the liner, wherein the bonding metal is capable of forming alloys with each of the engine block body material and the liner material, the bonding layer positioned between and metallurgically bonded to each of the liner and the cylinder bore to provide a substantially continuous metallurgical bond between the cylinder bore and the liner, wherein the bonding layer provides a substantially uninterrupted heat transfer path of metallic material between the liner and the block body.

2. An engine block in accordance with claim 1, wherein the metallic liner is formed from a ferrous material.

3. An engine block in accordance with claim 2, wherein the ferrous material is cast iron.

4. An engine block in accordance with claim 1, wherein the metallic liner is formed from an aluminum alloy.

5. An engine block in accordance with claim 4, wherein the aluminum alloy from which the liner is formed is an alloy different from the aluminum alloy from which the engine block body is formed.

6. An engine block in accordance with claim 1, wherein the bonding metal is zinc.

7. An engine block in accordance with claim 1, wherein the metallic material is an alloy containing a major proportion of zinc, on a weight basis.

8. An engine block in accordance with claim 1, wherein the bonding metal is tin.

9. An engine block in accordance with claim 1, wherein the bonding metal is an alloy containing a major proportion of tin, on a weight basis.

10. An engine block in accordance with claim 9, wherein the tin content on a weight basis is about 95% and the balance is substantially zinc.

11. A tubular cylindrical liner adapted to be pressed into a bore formed in an aluminum engine block, said liner comprising a tubular cylindrical structure having a cylindrical inner surface and a cylindrical outer surface, the outer surface including a metallic bonding layer having as a major constituent thereof on a weight basis a bonding metal having a melting temperature substantially lower than the melting temperature of the liner material and the melting temperature of a block receiving the liner, said bonding layer being capable of forming alloys with both the liner material and a block receiving the liner to provide a metallurgical bond between the bonding layer and the liner material and a metallurgical bond between the bonding layer and block.

12. A liner in accordance with claim 11, wherein the liner is formed from a ferrous material.

13. A liner in accordance with claim 12, wherein the liner is formed from cast iron.

14. A liner in accordance with claim 12, wherein the bonding metal is tin.

15. A liner in accordance with claim 11, wherein the liner is formed from an aluminum alloy.

16. A liner in accordance with claim 15, wherein the aluminum alloy from which the liner is formed is an alloy having a composition different from that of an engine block receiving the liner.

17. A liner in accordance with claim 15, wherein the liner is formed from aluminum alloy 390.

18. A liner in accordance with claim 11, wherein the bonding metal is zinc.

19. A liner in accordance with claim 11, wherein the bonding metal is an alloy containing a major proportion of zinc, on a weight basis.

20. A liner in accordance with claim 11, wherein the bonding metal is an alloy containing a major proportion of tin, on a weight basis.

21. A liner in accordance with claim 20, wherein the tin content on a weight basis is about 95% and the balance is substantially zinc.

22. A liner in accordance with claim 20, wherein the tin content on a weight basis is about 95% and the balance is substantially antimony.

23. A method of installing and securing a cylindrical liner in a cylinder bore of an internal combustion engine block, said method comprising:

a) providing a metallic liner having a cylindrical inner surface and a cylindrical outer surface;

b) applying a metallic bonding layer on the outer cylindrical surface of the liner to metallurgically unite with the liner material to provide intermetallic compounds, wherein the metallic bonding layer has as a major constituent on a weight basis a bonding metal having a melting temperature substantially lower than the melting temperatures of the engine block and of the liner, wherein the bonding metal is capable of forming alloys with each of the engine block material and the liner material;

c) providing an aluminum alloy engine block having at least one cylindrical bore;

d) applying a bonding layer of the metallic bonding layer material to the cylindrical bore to provide a metallurgically bonded coating having intermetallic compounds therein;

e) heating the liner and engine block to a temperature near the melting point of the bonding metal sufficient to soften or melt the bonding layer on the liner and on the cylindrical bore of the block;

f) pressing the heated liner into the bore in the heated block to cause fracturing of surface oxides of the bonding metal at the interface between the liner and the cylinder bore to metallurgically join the liner to the bore.

24. The method of claim 23, wherein the liner is formed from a ferrous metal.

25. The method in accordance with claim 24, wherein the liner is formed of cast iron.

26. A method in accordance with claim 24, wherein the clearance between the outer surface of the liner and the bore is about 0.002 inches.

27. A method in accordance with claim 23, wherein the liner is formed from an aluminum alloy that is different in composition from the aluminum alloy material of which the engine block is formed.

28. A method in accordance with claim 26, wherein the clearance between the outer surface of the liner and the bore is about −0.004 inches.

29. A method in accordance with claim 23, wherein the bonding metal is zinc.

30. A method in accordance with claim 23, wherein the bonding metal is an alloy containing a major proportion of zinc, on a weight basis.

31. A method in accordance with claim 23, wherein the bonding metal is tin.

32. A method in accordance with claim 23, wherein the bonding metal is an alloy containing a major proportion of tin, on a weight basis.

33. A method in accordance with claim 32, wherein the tin content on a weight basis is about 95% and the balance is substantially zinc.

34. A method in accordance with claim 32, wherein the tin content on a weight basis is about 95% and the balance is substantially antimony.

* * * * *